US005626194A

United States Patent [19]

White

[11] Patent Number: 5,626,194

[45] Date of Patent: May 6, 1997

[54] FIRE FIGHTING SYSTEM

[75] Inventor: Richard W. White, San Diego, Calif.

[73] Assignee: FAV, Inc., San Diego, Calif.

[21] Appl. No.: 308,981

[22] Filed: Sep. 20, 1994

[51] Int. Cl.[6] ..... A62C 27/00

[52] U.S. Cl. ..... 169/24; 169/54; 169/62

[58] Field of Search ..... 169/24, 54, 62

[56] References Cited

U.S. PATENT DOCUMENTS

| | | | |
|---|---|---|---|
| 1,383,788 | 7/1921 | Clark | 169/62 |
| 3,688,846 | 9/1972 | Lease | 169/62 |
| 3,724,554 | 4/1973 | Rupert et al. | 169/24 |
| 3,762,478 | 10/1973 | Cummins | 169/24 |
| 3,762,479 | 10/1973 | Fike, Sr. et al. | 169/28 |
| 3,831,173 | 8/1974 | Lerner | 343/5 R |
| 3,832,173 | 8/1974 | Cerankowski et al. | 96/3 |
| 4,129,185 | 12/1978 | Hasselbacher | 169/62 |
| 4,271,646 | 6/1981 | Mills | 52/165 |
| 4,593,855 | 6/1986 | Forsyth | 239/74 |
| 4,852,656 | 8/1989 | Banahan | 169/91 |
| 5,032,841 | 7/1991 | Shulenberger | 342/37 |
| 5,113,946 | 5/1992 | Cooper | 169/24 |
| 5,128,803 | 7/1992 | Sprafke | 259/403 |
| 5,161,614 | 11/1992 | Wu et al. | 166/277 |
| 5,202,163 | 4/1993 | Uihlein et al. | 427/314 |
| 5,214,867 | 6/1993 | Weatherly et al. | 37/357 |
| 5,260,708 | 11/1993 | Auterman | 342/25 |
| 5,267,763 | 12/1993 | Klein | 293/128 |
| 5,274,924 | 1/1994 | Lee | 30/379 |
| 5,301,756 | 4/1994 | Relyea et al. | 169/24 |
| 5,313,770 | 5/1994 | Smothers | 56/12.7 |
| 5,315,915 | 5/1994 | Sprafke | 89/36.14 |

FOREIGN PATENT DOCUMENTS

| | | | |
|---|---|---|---|
| 2652268A | 3/1991 | France | 169/24 |
| 2680692A1 | 3/1993 | France | 169/24 |
| 131901 | 8/1978 | German Dem. Rep. | 169/24 |
| 3620603 | 1/1987 | Germany | 169/24 |

*Primary Examiner*—Gary C. Hoge

*Attorney, Agent, or Firm*—Brown, Martin, Haller & McClain

[57] ABSTRACT

A Fire Fighting System includes a vehicle with one or more mounted motors, a fire shield system, and an emergency fire retardant discharge system. The motors are equipped with cutting elements including cutting teeth, paddle teeth, and severe duty fire whips. The fire shield system may include a series of flame and heat retardant coverings placed on all exposed parts of the system to prevent damage from exposure to extreme heat. The emergency fire retardant discharge system distributes chemical fire retardant in the event the fire comes too close to the system. In operation, the vehicle operator positions the system at the edge of a fire line and energizes the motors causing the cutting elements and whips to begin rotating. Once rotating at full speed, the vehicle is advanced along the fire line with the cutting elements cutting and slashing the burning vegetation. Once cut, the burning vegetation is thrown aside by the severe-duty fire whips that rotate to throw the debris back towards the fire. Thus, as the Fire Fighting System advances along the fire line, a fire break is created which is devoid of any combustible material.

18 Claims, 6 Drawing Sheets

FIRE FIGHTING SYSTEM

FIELD OF THE INVENTION

This invention relates generally to a system and method for fighting fires. More specifically, the present invention pertains to a system and method of fighting fires which removes the fire's fuel source, thereby stopping the advance of the fire.

BACKGROUND OF THE INVENTION

It is well-known that brush land fires, timber fires and urban wild fires destroy vast tracts of land and property every year in the United States and around the world. The vast and uncontrolled nature of the destruction is in part due to the fact that fire fighting techniques have not improved in many years, the sole exception being air attack fire fighting, which consists of nothing more than dumping water and fire retardant upon the fire from the air. Most forest fire fighting is still done with hand crews using fire picks and shovels. A consistent problem is that no rough terrain vehicle yet exists that can protect its operator and safely fight fire at point blank range. This problem is all the more vexing in urban areas, where steep hillside canyon rims are crowded with expensive homes. When brush fires erupt, home owners are often left to fight the fire on their own with their garden hoses until the aerial fire tankers can arrive. This is so because no fire fighting equipment presently exists that can operate in the fire environment on rough or steep terrain. This often leads to a wholesale loss of property as overtaxed fire crews are reduced to being nothing more than traffic cops evacuating residents from neighborhoods that are being abandoned to fire.

When a fire is consuming wild lands or urban areas adjacent to wild lands, the conventional method of fighting the fire is to hose the fire with water from fire hydrants or water hauling vehicles, and to bomb the fire with water or fire retardant using airplanes or helicopters, or to fight the fire on the ground using hand tools or bulldozers or earth casting type machines. Under the current practice, protection of property must become a secondary goal whenever fire conditions threaten fire crews and their apparatus. Thus, when conditions are adverse, fire fighters are reduced to the role of "defenders," falling back to pre-established firebreaks, because no equipment exists that can safely attack fire at point blank range.

In recent years, increasingly sophisticated technology has been developed in a number of industries not related to fire fighting. These technical developments, if brought to bear in a single unit, give rise to the feasibility of a novel device such as the present invention. The following references, for example, disclose a variety of such sophisticated technologies.

U.S. Pat. No. 4,852,656, issued to Banahan in 1989, entitled "Fire Extinguishing Apparatus," discloses a tractor drawn fire extinguishing apparatus having a means of removing overburden and soil adjacent to burning terrain to expose nonflammable soil. Once removed, the soil particles are pumped through a guide chute thereby directing the soil particles onto the burning areas.

U.S. Pat. No. 5,214,867, issued to Weatherly, et al, in 1993, entitled "Forest Fire Extinguishing Apparatus," discloses a tractor drawn type implement for excavating soil with disks. Once excavated, the soil is then funneled into a pile in front of a rotating fan which throws the soil in a particular direction thereby covering, and extinguishing, the fire.

U.S. Pat. No. 4,593,855, issued to Forsyth in 1986, entitled "Vehicle Mounted Fire Fighting Apparatus," discloses a small truck-mounted device for fighting fires. This truck-mounted device pumps a liquid fire-fighting chemical through spray nozzles and hoses positioned about a truck enabling the truck to be used for close-range fire suppression.

U.S. Pat. No. 5,274,924, issued to Lee in 1994, entitled "Weed, Brush, and Small Tree Cutter," discloses a weed, brush and small tree cutter attachment for an ordinary rotary power lawnmower. The attachment consists of a chainsaw-type blade projecting from the front of the mower and is driven by a sprocket mounted to the rotary mower shaft.

U.S. Pat. No. 5,313,770, issued to Smothers in 1994, entitled "Jam-Proof Rotary Weed Cutter," discloses a rotary weed cutter tool that uses a number of flexible cutting filaments rotating about an axis at high speed. These flexible cutting filaments establish a cutting plane as the device is advanced through weeds or other brush.

U.S. Pat. No. 5,161,614, issued to Wu, et al, in 1992, entitled "Apparatus And Method For Accessing The Casing Of A Burning Oil Well," discloses a heat shielded apparatus and method for accessing the casing of a burning oil well. Specifically, the apparatus includes a sled-like carriage equipped with a digging device for excavating the area around the oil well casing to extinguish the well fire by applying a well plugging device.

U.S. Pat. No. 5,202,163, issued to Uihlein, et al, in 1991, entitled "Surface Coating For Protecting A Component Against Titanium Fire And Method For Making The Surface Coating," discloses a method for coating a metal surface for protection against titanium fires. This method consists of embedding ceramic fibers in a matrix of high-temperature lacquer and aluminum powder, and applying the matrix to the metal to be protected.

U.S. Pat. No. 3,762,478, issued to Cummins in 1973, entitled "Remote Controlled Hazard-Fighting Vehicle," discloses a remote-controlled track-mounted vehicle with a movable turret. A nozzle mounted to the moveable turret is attached to a hose that leads to a source of pressurized fire-retardant fluid. Thus, by rotating the turret, a stream of the fire-retardant fluid may be directed at various locations in a fire fighting environment.

U.S. Pat. No. 5,267,763, issued to Klien in 1992, entitled "Vehicle Side Guard," discloses a protective device consisting of a light-weight material having a magnetic backing. The protective device attaches to a vehicle to prevent dings and other surface damaging contact.

U.S. Pat. No. 5,315,915, issued to Sprafke in 1993, entitled "Periscope At The Hatchway Of A Combat Vehicle," discloses a periscope at the hatchway of a combat vehicle. Specifically, the periscope comprises two sections separated by a dust brush that allows the hatch to be opened while insuring that minimal dirt interferes with the optical alignment of the periscope.

U.S. Pat. No. 5,128,803, also issued to Sprafke in 1992, entitled "Combat Vehicle With A Hatchway In Its Armored Roof And Including A System Of Periscopes," discloses a system of periscopes for a combat vehicle having an ocular lens inside the vehicle, an objective lens outside the vehicle, and an optical path extending between them.

U.S. Pat. No. 5,260,708, issued to Auterman in 1993, entitled "Three Dimensional Interferometric Synthetic Aperture Radar Terrain Mapping With Unambiguous Phase Unwrapping Employing Subset Bandwidth Processing," discloses a three dimensional interferometric synthetic aperture radar terrain mapping system which produces a terrain map from the air. As disclosed, this radar mapping system is installed on an aircraft which is flown in a repetitive pattern over the territory to mapped.

U.S. Pat. No. 3,831,173, issued to Lerner, et al, in 1974, entitled "Ground Radar System," discloses a system to locate underground objects from a moving vehicle.

U.S. Pat. No. 5,032,841, issued to Shulenberger in 1991, entitled "Method And Apparatus For Ground Radar Information Display System," discloses a new use for existing air traffic control radar signals. Specifically, raw data from the existing Air Traffic Control Radar Beacon System is processed and displayed to show positional information for commercial and general aviation purposes.

U.S. Pat. No. 3,762,479, issued to Fike, et al, in 1973, entitled "Remotely Actuatable Portable Fire Suppression Apparatus," discloses a remotely activated portable fire suppression apparatus for use in a relatively confined area. Such areas would include engine compartments and restaurant ventilation hoods.

The preceding fire fighting devices are not specifically designed to traverse rough terrain to engage and destroy wild fire in the fire environment. The preceding radar devices are not specifically designed for use in guiding a fire-fighting vehicle over rough terrain in a fire environment by use of a three-dimensional topographical computer monitor display. The preceding automatic fire suppression apparatus is not specifically designed for highly localized all-direction massive discharge of fire retardant for suppression of fire in catastrophic fire conditions.

As a result of the above, it is a general object of the present invention to provide a Fire Fighting System having directionally controlled reversible rotary cutting elements, paddles, and fire whips designed for severe duty. These rotary cutting elements are mounted individually, or as in the preferred embodiment, in a gang and shall be adaptable for mounting to a highly mobile track excavator or other vehicle that can be used to engage fire and to destroy fire and combustible material, such as trees and brush.

It is another object of the present invention to provide a Fire Fighting System having the ability to toss the combustible material aside and cover it with earth by engaging the rotating cutting elements, fire whips, and paddles with the soil.

It is also an object and advantage of the present invention to provide a Fire Fighting System having a system of vehicle cabin enhancements. These cabin enhancements could include fire barrier shields, heat-proof glass, cabin climate control and sensory systems, thereby allowing the operator of the System to operate safely within the fire environment, and to provide the operator with information regarding exterior terrain and ground conditions so that operations can be maintained in the fire environment.

It is another object and an advantage of the present invention to provide a Fire Fighting System having a non-combustible fire barrier shield system for an excavator or vehicle. This system of fire shields can be generally detachable by use of fastening devices so that the excavator or vehicle can be returned to other use when not fighting fires.

It is yet another object and advantage of the present invention to provide a Fire Fighting System where the non-combustible fire barrier shield system employ cementous or other fire-stop material which, in the form used and under the conditions anticipated, will not ignite, burn, support combustion or release flammable vapors when subjected to fire or heat.

It is still another object and an advantage of the present invention to provide a Fire Fighting System having a vehicle cabin with telescope-mounted video, forward-looking ground radar and GPS/GIS topographical information map and infrared video. Such instrumentation allows the operator of the vehicle to be constantly aware of ground conditions and vehicle location relative to the proximity of a fire and other surroundings when smoke obscures normal vision.

It is also an object of the present invention to provide a Fire Fighting System, mountable on an excavator or other vehicle, with ground sensing capabilities and a training wheel having a float valve to assist the operator in use of the Fire Fighting System.

It is yet another object to the present invention to provide a Fire Fighting System mountable on an excavator, or other vehicle, with a tree cutting shear which, when employed in combination with the training wheel, can safely cut and push over a tree, thereby removing the tree from the path of the advancing Fire Fighting System.

It is another object and advantage of the present invention to provide Fire Fighting System that can be operated remotely in some configurations.

It is still another object of the present invention to provide a Fire Fighting System of the present invention which is safe and easy to use, relatively easy to manufacture, and comparatively cost effective.

SUMMARY OF THE INVENTION

In an exemplary embodiment, the system of the present invention includes a fire fighting assembly attached to the boom of a construction excavator. Specifically, this fire fighting assembly is attached to the bucket hinge on the end of the excavator crowd, and is positionable using the existing bucket ram.

The fire fighting assembly includes a tee bar root, tee bar head, and tee bar arms. Specifically, the tee bar root extends from the excavator crowd and terminates into the tee bar head. This tee bar head is perpendicular to the tee bar root and has a hinge at each end. A tee bar arm attaches to each of these hinges and extends from the tee bar head to form a continuous bar perpendicular from the tee bar root.

At a number of positions along the tee bar head and tee bar arms, a reversible hydraulic motor is mounted to face away from the excavator. A rotatable fire destruction device is mounted to the rotating shaft of each of these hydraulic motors and includes various cutting element teeth, paddle teeth, and severe duty fire whips. Thus, when the hydraulic motor is engaged, the various teeth and whips rotate to strike, cut, and direct burning debris away from the excavator and back towards the fire.

Mounted beneath the tee bar head is a pair of training wheels that roll along the ground. These training wheels are positioned to support the weight of the tee bar head, hydraulic motors, and rotatable fire destruction devices, thereby insuring that the tee bar is maintained at a particular height. In order to assist the operator in maintaining the tee bar at a particular height, a pressure-sensitive float valve and radar ground sensor may be mounted on the tee bar. By maintaining the tee bar at a consistent height, the rotating whips and teeth do not strike the ground with sufficient force to stop or slow their rotation.

A number of other safety and instrumentation devices are incorporated into the exemplary embodiment of the present invention. More specifically, an instrumentation suite is installed in the excavator. This instrumentation suite includes a periscope that is located on the construction excavator and is equipped with a standard video camera, infrared video camera, global positioning system (GPS) receiver, a radar transmitter/receiver, compass, and temperature sensors, with the outputs of all of these being displayed on monitors viewable by the operator of the excavator.

In addition to the instrumentation elements, an emergency fire discharge unit is mounted on the excavator and, when activated, discharges fire retardant in all directions from the excavator. Such discharge will inhibit the approach of any fire towards the excavator thereby enabling the operator of the excavator to maneuver it to safety.

Operation of the preferred embodiment includes positioning of the excavator equipped with the tee bar and rotating cutting devices at one end of a fire line. Then, using the instrumentation devices, the operator advances the excavator along the fire line and engages the rotating cutting devices in a direction to flip debris towards the fire. As the cutting devices strike and cut shrubs, brush, and small trees, the debris is flipped back into the fire. Thus, as the excavator advances along the fire line, a wide fire-break is cut, thereby preventing the spread of the fire beyond the fire-break.

In addition to removing trees using the rotating cutting devices, unwanted trees may also be removed with the tree shear. The tree shear is mounted under the tee bar and is positioned such that in the event there is a tree too large to be removed by the rotating teeth and whips, the tree shear may be employed to simply shear off the tree and set it out of the path of the excavator.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DESCRIPTION OF A PREFERRED EMBODIMENT

Figure 1:
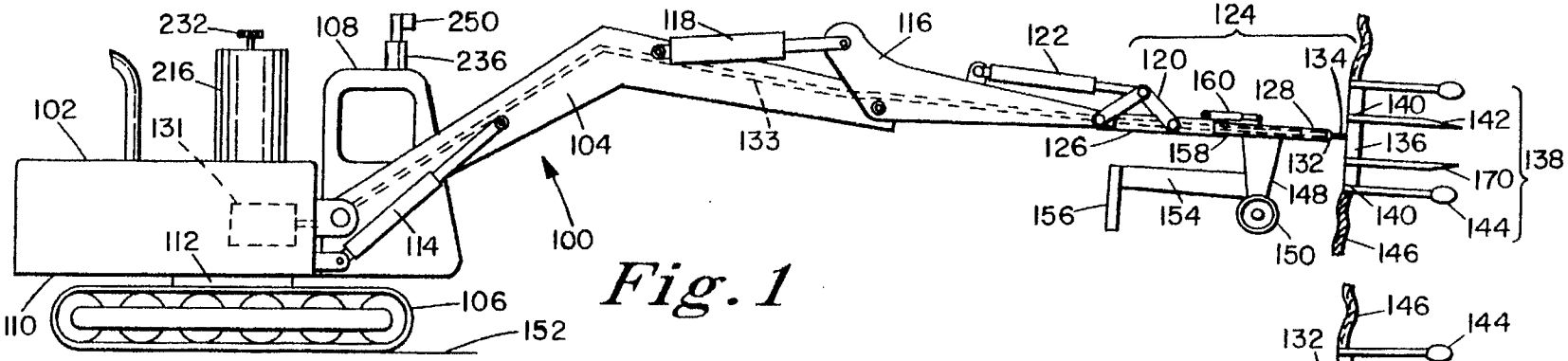
FIG. 1 is a side view of the system of the present invention, showing a construction excavator configured to fight fires.

As illustrated in FIG. 1, the Fire Fighting System of the present invention is shown and generally designated 100. The system of the present invention as shown includes a construction excavator 102. It is to be appreciated, however, that the system of the present invention could be mounted on a variety of other vehicles. Such vehicles could include, for example, bulldozers, tractors, fire trucks, or heavy duty utility vehicles.

The excavator is a commonly used heavy construction vehicle which is well known for its versatility and strength. As shown in FIG. 1, the construction excavator 102 is well-suited for use in the system because of its ability to extend its boom 104 well in front of the vehicle. Moreover, the excavator has a rugged track propulsion system 106 which is ideal for use in low traction environments, such as brush-covered hillsides and forests. In order to fully discuss the system 100 incorporating an excavator, the various components of an excavator 102 will be discussed generally.

The main body of the excavator 102 includes an operator cabin 108 and an engine compartment 110 that are mounted to an undercarriage 112 that rotates on a pair of tracks 106. These tracks 106 are independently controlled, thereby enabling the movement and turning of the excavator 102 by energizing either one or both of the tracks 106. The excavator operator sits in the cabin 108 facing away from the excavator 102, giving the operator an unobstructed view of the surroundings and work area. The main boom 104 is extendable from the front of the excavator 102 and is articulable by one or more hydraulically activated boom rams 114. A crowd 116 hinges from the end of the boom 104 and is articulable using the hydraulically activated crowd ram 118. At the end of the crowd 116, a bucket hinge 120 is mounted and moveable with a bucket ram 122. Attached to the crowd 116 and bucket hinge 120 is the tee arm assembly 124 of the present invention. From this Fig., and with reference to FIG. 4, it is appreciated that the boom 104, crowd 116, and bucket hinge 120 may be simultaneously articulated in order to position the tee arm assembly 124 in virtually any particular orientation or position.

The tee bar assembly 124 extends form the crowd 116 and includes a tee bar 126 which terminates at the tee bar head 128. Attached to the tee bar head 128, and extending perpendicularly from the tee bar 126, are a pair of tee arms 130 (shown more clearly in FIG. 2). Three reversible rotary mechanisms 132, such as motors, are mounted to the tee arms 130 and tee bar head 128. The motors 132 used in the present invention are hydraulically driven. It should be noted, however, that electric or pneumatic motors are equally effective and could be used. In fact, a mechanical take-off 131 can be used to power the rotary mechanism 132. The take-off 131 may be mechanically likened to the rotary mechanisms 132 by a drive linkage 133 (shown in phantom). Additionally, it should be appreciated that while the present embodiment is shown with three or four motors 132, any number could be used. Each reversible motor 132 has a rotary shaft 134 that extends forward from the tee bar head 128 or tee arm 130. Attached to each rotary shaft 134 is a cutting device 136 having a number of cutting elements 138 with integral tooth sockets 140, cutting element teeth 142, paddle teeth 144, and severe duty fire whips 146.

The tee bar 126 and tee arms 130 are supported by a training wheel assembly 148 and a pair of training wheels 150. The length of the training wheel assembly 148 ensures that the tee bar 126 is maintained a certain height from the ground. By insuring that the tee bar is a certain distance above the ground 152, the clearance required for the cutting device 136 is maintained. More specifically, by maintaining a certain clearance for the cutting devices 136, the cutting element teeth 142, paddle teeth 144, and severe duty fire whips 146 are allowed to rotate without hitting the ground 152. In addition to maintaining the height of the tee bar 126, the training wheel assembly 148 also supports the tree shear attachment 154 and tree shear 156. The details of the tree shear attachment 154 and the tree shear 156 will be more fully shown and discussed in connection with FIGS. 3 and 4.

Figure 2:
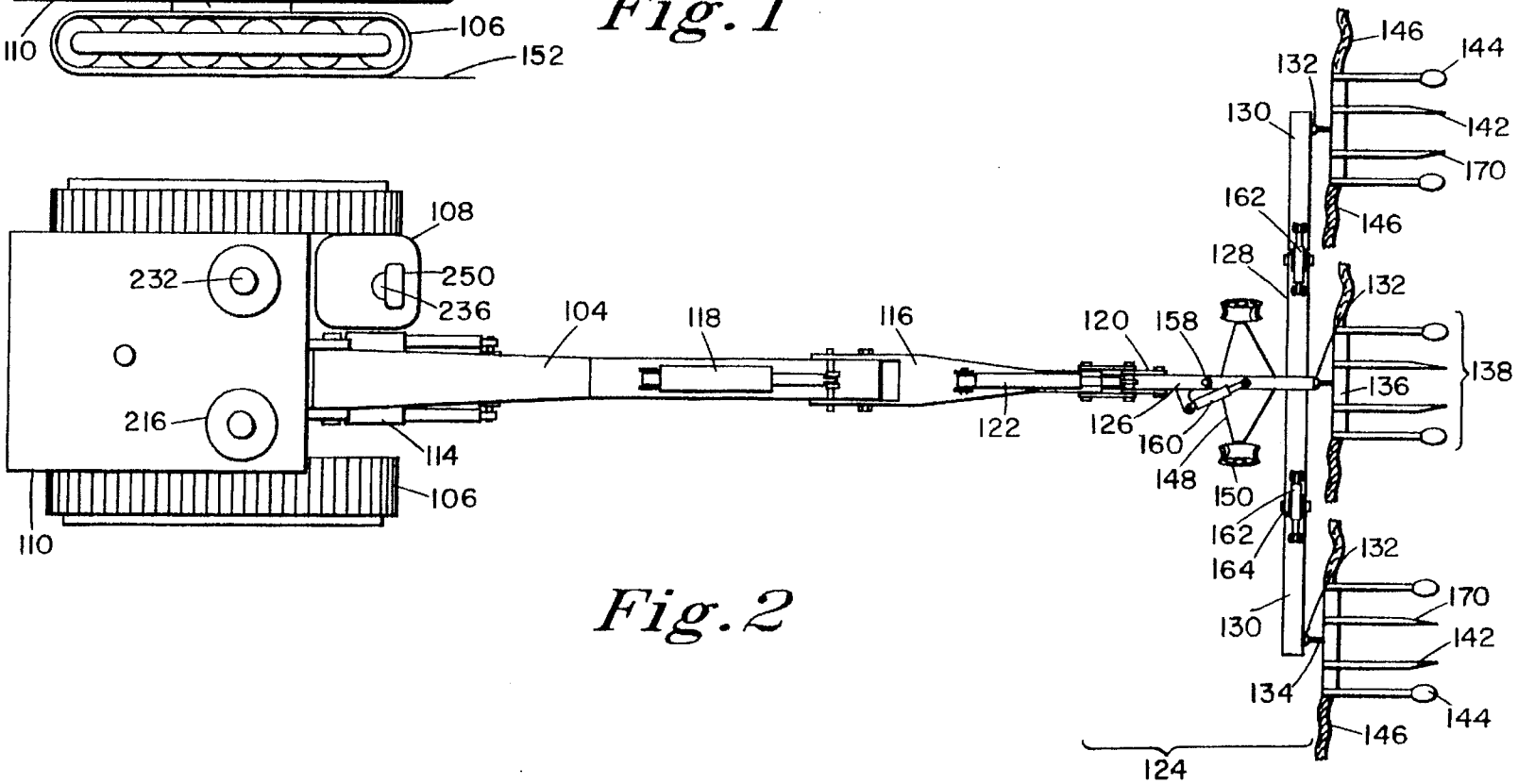
FIG. 2 is a plan view of the system of the present invention, showing the cutting element orientation and tee arms, tee bar and tee bar head.
Figure 3:
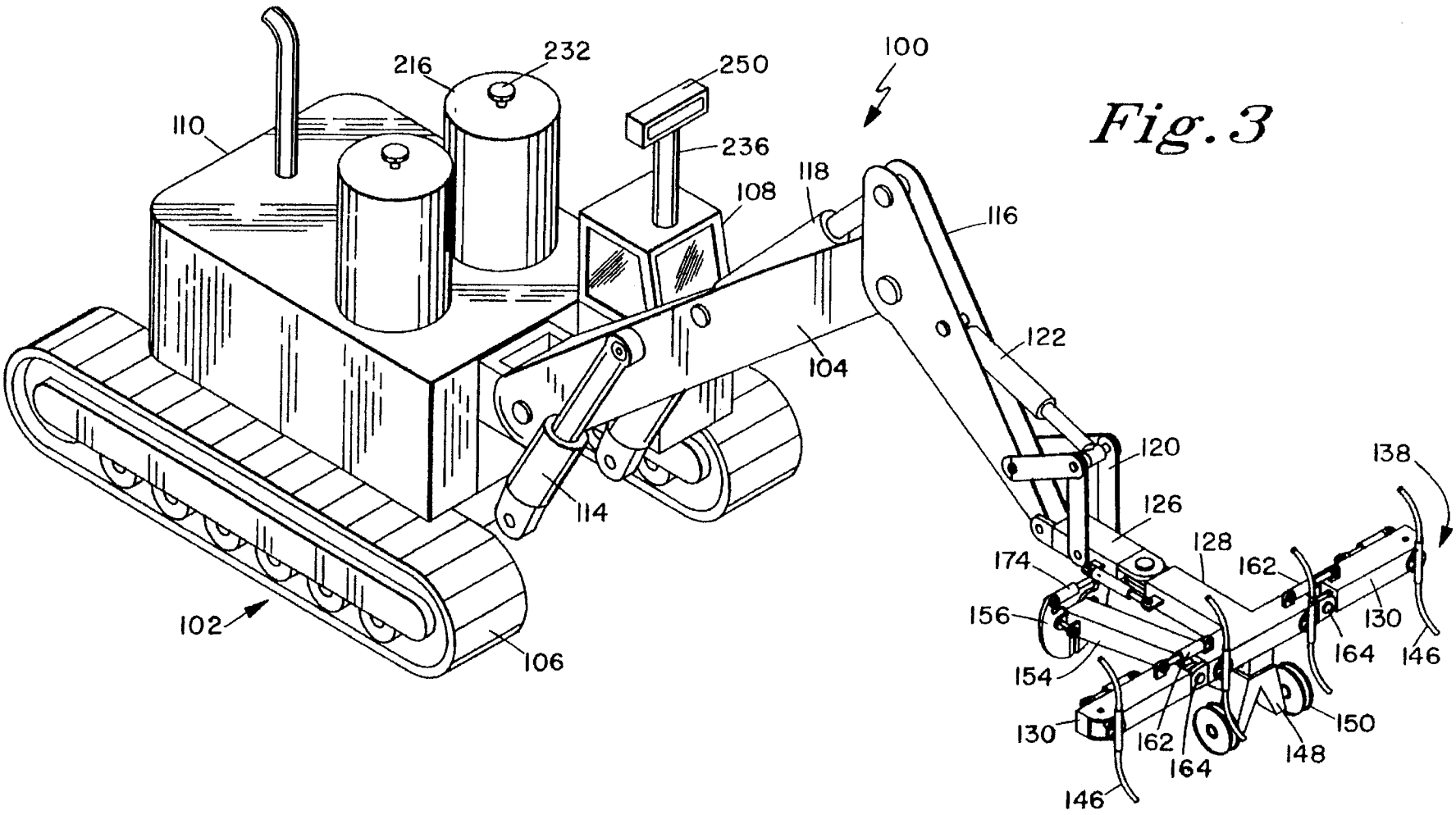
FIG. 3 is a perspective view of the system of the present invention, showing the various component parts of the tee bar and tree shear attachment.

Referring now to FIG. 2, the various features of the tee bar assembly 124 are shown in more detail. As discussed above in connection with FIG. 1, the tee bar 126 extends from the bucket hinge 120 attached to the end of the crowd 116 to the tee bar head 128 and is moveable using the bucket ram 122. Midway between the end of the crowd 116 and the tee bar head 128 is a tee bar hinge 158. This tee bar hinge 158 facilitates the movement of the tee bar head 128 and tee arms 130 away from a perpendicular relationship to the tee bar 126. The movement is facilitated with the tee bar ram 160 which allows the operator of the system to hydraulically articulate the tee bar hinge 158 in a side-to-side direction. Such articulation is particularly useful when the excavator 102 is unable to attack the fire line by traveling along the line. The tee bar hinge 158 allows the operator of the system to swing the boom 104 away from the direction of travel, yet articulate the tee bar head 128 and tee arms 130 such that the cutting elements 138 can attack a fire line parallel to the path of the vehicle. As a result, the system may be used at a distance from the fire line, while creating an effective fire break. Also, the ability to position the tee bar 126 away from the path of travel facilitates the creation of fire breaks on terrain too rough for the vehicle, such as steep embankments, Focusing now on the tee bar head 128 and tee arms 130, the positioning of the three cutting devices 136 is clear. It should be appreciated that, given the placement and diameter of the cutting devices 136, nearly every inch of brush along the tee bar head 128 and tee arms 130 will be exposed to one of the three cutting elements 138. Referring now to FIG. 3, the system 100 of the present invention, including a construction excavator 102, is shown in perspective. From this view, certain aspects of the tee bar head 128 and tee arms 130 are apparent. Specifically, the tee arm rams 160 are shown attached to both the tee bar head 128 and the tee arm 130 and span the tee arm hinge 162. By activating these two tee arm rams 160, the two tee arms 130 articulate downwards at the tee arm hinges 164 to effectively shorten the horizontal length of the tee bar head 128 and tee arms 130. This shortening facilitates the transport of the system 100 by narrowing the distance required for a transport vehicle. In other words, because the tee bar head 128 and tee arms 130 are bent instead of straight, the system of the present invention may be transported using a slightly over-sized trailer.

Referring generally to FIGS. 2 and 3, the cutting elements 138 are shown extending from the tee bar head 128 and tee arms 130. These cutting elements 138 include tooth sockets 140, cutting teeth 142, severe duty fire whips 146, and paddle teeth 144. The tooth sockets 140 are located on a cylindrical housing 166 which is attached to the motor shaft 134 to project forward from the tee bar head 128 and tee arms 130. Each tooth socket 140 is sized to receive either a cutting element tooth 142 or a paddle tooth 144. Once inserted into the socket 140, the combination of cutting elements 142 and paddle teeth 144 may be rotated by actuating the motor 132.

The cutting teeth 142 are elongated cutting instruments that have a shaft 168 having one end that is insertable into the tooth sockets 140, and the opposite end sharpened to a cutting edge 170. Because the cutting edge 170 is sharpened, when the cylindrical housing 166 is rotated, the cutting edge 170 will strike and cut any debris or vegetation in its path. Similarly, the paddle teeth 144 are also elongated instruments having a shaft 168 that is insertable into the tooth sockets 140. These paddle teeth 144, however, are equipped with a broad digging paddle 172 that is designed to scoop and throw dirt and debris when rotated to strike the ground. Each of the cutting teeth 142 and paddle teeth 144 is made of a hardened steel or carbide-tipped steel. It should be appreciated, however, that any material having similar hardness and strength could be used as long as a cutting edge can be reliably formed.

In addition to the cutting elements 138, at least one severe duty fire whip 146 is mounted to each motor 132. This mounting is achieved by attaching the fire whip 146 to the cylindrical housing 166. The fire whip 146 extends out past the cylindrical housing 166 such that the fire whip will swing freely of the cutting elements 138 when the motor is engaged. These severe duty fire whips 146 may be made of any sturdy free-swinging material. Such materials, for example, include wire rope, steel cable, or chain.

Also shown in FIG. 3, the training wheel assembly 148 extends downwards from the tee bar 126, forming a tripod structure when mounted on an excavator 102. It is to be appreciated that due to the rigid nature of the training wheel assembly 148, the tee bar head 128 and tee arms 130 will remain at a constant elevation despite the loads that are present on the bars. The training wheels 150 are mounted to the training wheel assembly 148 at an angle. This is so to insure that the training wheels 150 engage the soil in such a manner so as to provide directional control for the tee bar 126 and cutting elements 138. This directional control will, perhaps, be most important in environments where there is severe smoke that prohibits the operator of the system 100 from visualizing the path of the tee bar 128 and cutting elements. As an alternative to the training wheels 150, a pair of skids (not shown) may be used. Skids would function like the training wheels 150 to engage the soil to assist in the directional control of the system. To aid in such control, the skids may be placed at an angle to improve their traction on the soil. More specifically, by placing the skids on their edge, the skid will cut into the soil and provide improved directional control.

The training wheel assembly 148 can also be equipped with a float valve and ground sensor radar (not shown). The combination of these two devices, as mounted on the tee bar head 128, assist in the hydraulic control of the excavator 102 to help maintain contact of the training wheels 150 to the ground 152. In fact, by activating the float valve, the system operator is relieved of the arduous task of ensuring that the severe duty fire whips 146 strike the ground. Such assistance is particularly useful when fighting fires in environments where the terrain is rough.

Attached to the training wheel assembly 150 is the tree shear attachment arm 154 and associated tree shear 156. From this Fig., the mechanical components of the tree shear 156 are readily seen. The tree shear 156 is movably attached to the end of the tree shear attachment arm 154 and articulable using a tree shear ram 174. As appreciated from this view, when the tree shear ram 174 is activated, the tree shear blades 176 are forced together, thereby pinching and cutting anything that is present between the two shear blades 176.

Figures 4, 14:
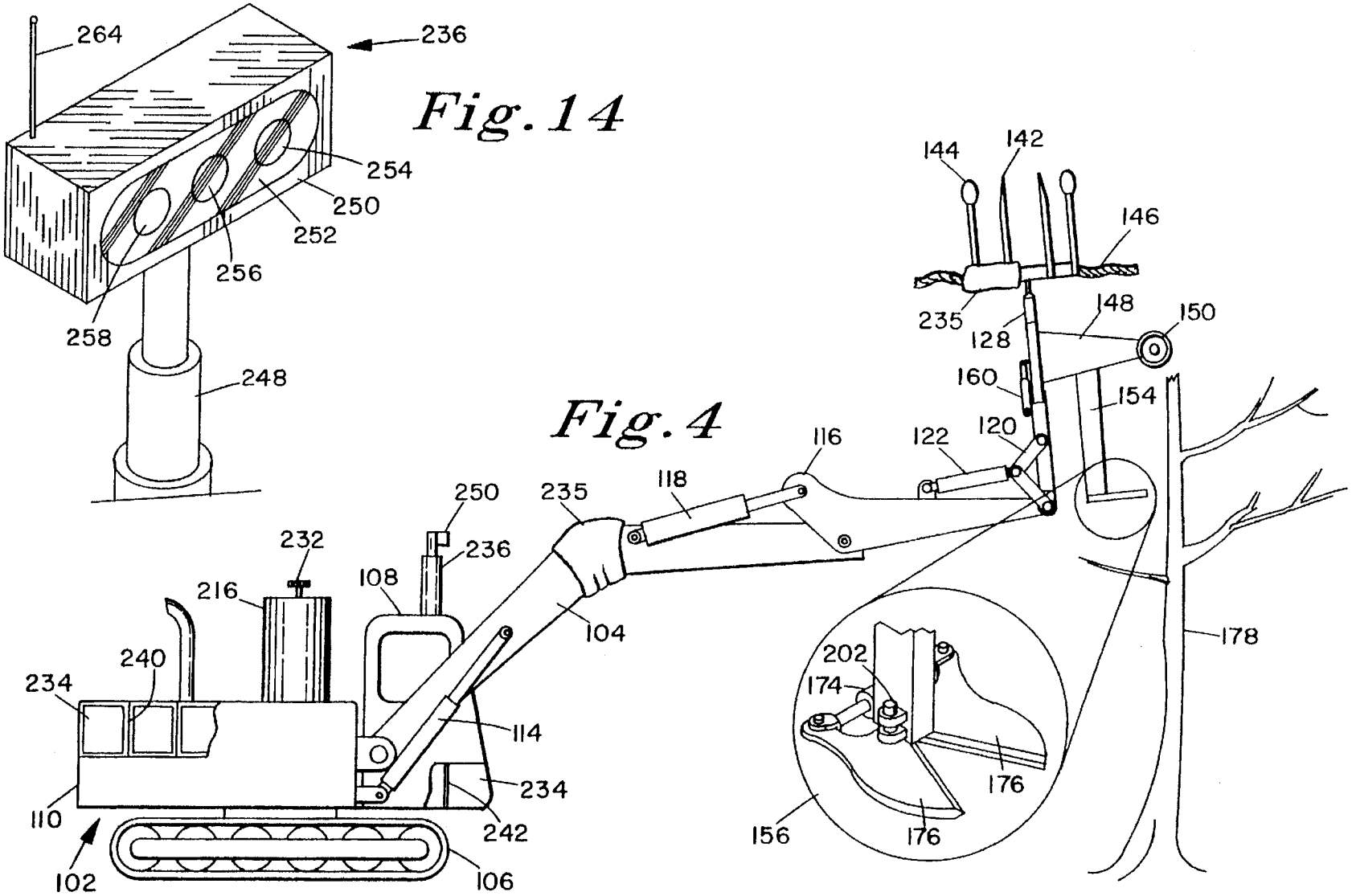
FIG. 4 is a side view of the system of the present invention, showing the orientation of the tee bar during use of the tree shear attachment.
FIG. 14 is a perspective view of the periscope showing some of the various instrumentation and communication devices of the Fire Fighting System of the present invention.

Referring now to FIG. 4, the system 100 of the present invention is shown with the tree shear 156 in the process of removing an unwanted tree 178. By articulating the bucket ram 122, the tee bar 126 is moved to a vertical position with the motors 132 pointing upwards. In this position, the training wheel assembly 148 is placed against the trunk of the tree with the training wheels 150 on opposite sides of the trunk. As the training wheel assembly 148 is advanced over the trunk of the tree 178, the tree shear blades 176 are also advanced around the trunk. Once the tree shear blades 176 are positioned on each side of the trunk, the tree shear ram 174 is activated, thereby severing the trunk and allowing the system to simply push the tree 178 out of the way.

FIG. 4 also shows how the cutting elements 138 can be used to remove burning debris from areas other than those directly in front of the system 100. More specifically, because of the reaching ability of the boom 104, crowd 116 and tee bar assembly 124, a variety of surfaces and debris may be cleared. For example, in the event that the lower branches of a tree are burning, the cutting elements could be positioned to destroy only those lower branches that are affected by fire. This would allow the destruction of the fire, while minimizing the damage caused by the fire to surrounding vegetation. In accordance with the application of the system to low lying branches, the cutting elements could be used to remove burning debris from other structures as well. For example, burning shingles could be scraped or otherwise removed from the roof of an otherwise unaffected structure with great precision, thereby saving the structure from otherwise certain loss. In addition to the fire fighting capabilities listed above, the ability to control the positioning of the cutting elements 138 and severe duty fire whips 146 uniquely suit the system 100 for other applications, including the removal of paint and plaster from ships and buildings.

Figure 5:
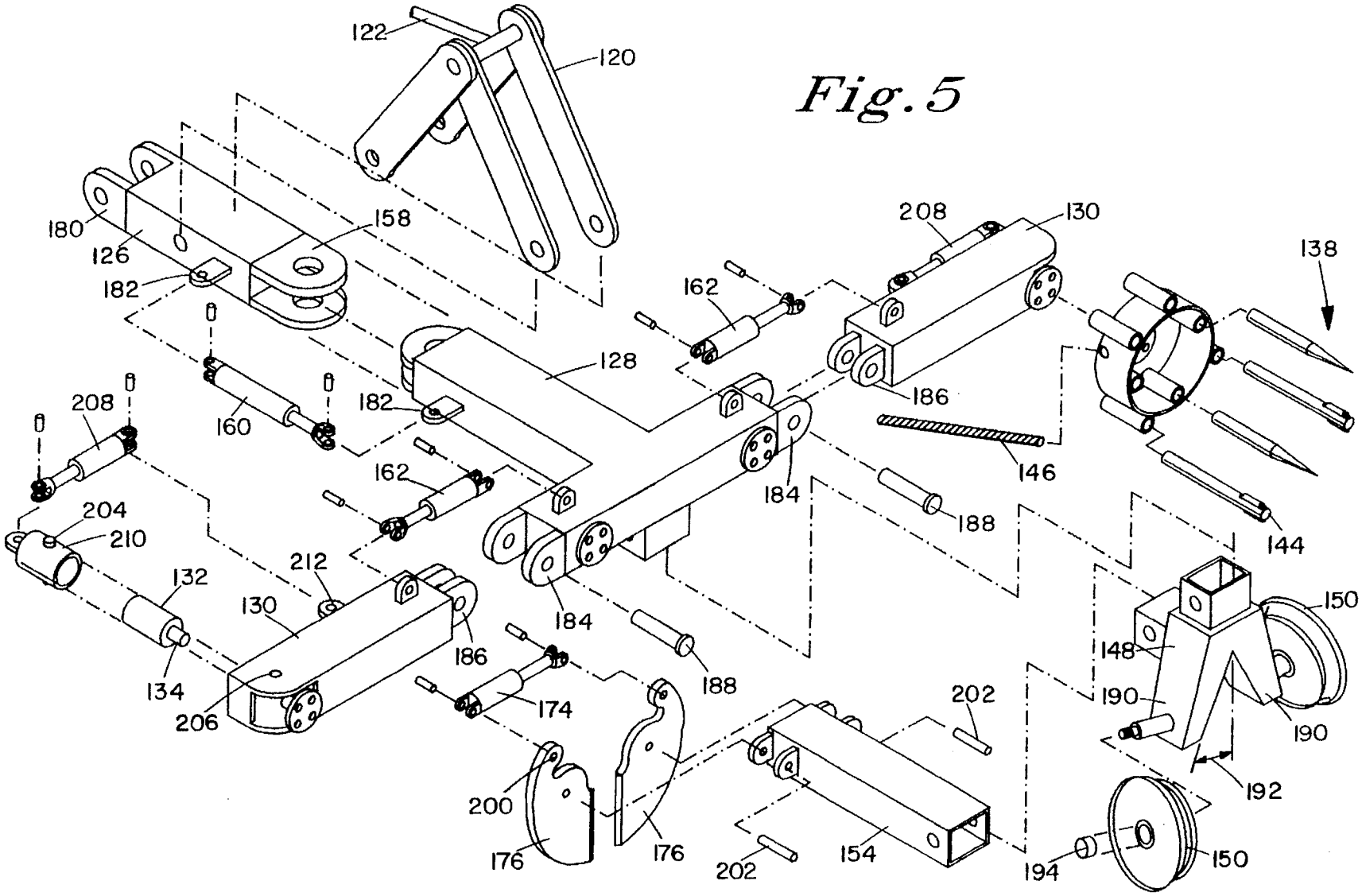
FIG. 5 is a detailed view of the tee bar assembly showing the component parts of the tee bar, and their mechanical interaction.

Referring now to FIG. 5, the various components of the tee bar, tee bar head, and tee arms are shown in exploded detail. As shown, the base of the tee bar 126 is equipped with a pair of hinge plates 180 that are aligned with the end of the crowd 116 and secured with a pin (not shown). The bucket hinge 120 is attached to the tee bar 126 slightly forward of the hinge plates 180 and secured in place with a bucket hinge pin (not shown). This pin securely attaches the bucket hinge to the tee bar, yet allows for movement of the bucket hinge about the pin.

The tee bar hinge 158 is located midway between the tee bar hinge plates 180 and the tee bar head 128. As discussed above, the tee bar hinge 158 allows the tee bar head 128 to be articulated from side-to-side by actuating the tee bar ram 160. This tee bar ram 160 is attached to the tee bar 126 using a pair of tee bar ram mounting brackets 182.

The tee bar head 128 has two sets of tee bar head hinge plates 184 at each end of the tee bar head 128. These tee bar hinge plates 184 are positioned to align with tee arm hinge plates 186 located on the end of the tee arms 130 and the two sets of hinge plates 184, 186 may be attached using a tee arm hinge pin 188. The tee arm hinge pin 188 allows the tee arms 130 to be angled downwards from the tee bar head 128 by actuating the tee arm ram 162. This movement, as mentioned above, shortens the horizontal width of the tee bar head 128 and tee arms 130 so that the system of the present invention can be transported using trailers having standard widths.

Figure 6:
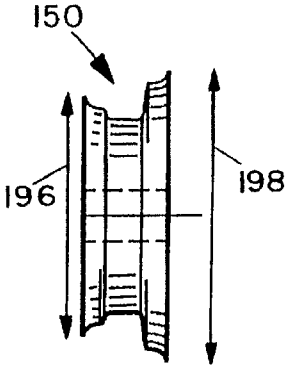
FIG. 6 is a detail view of the training wheel taken along line 6—6 of FIG. 5.

Mounted to the underside of the tee bar head 128 is the training wheel assembly 148. The training wheel assembly 148 is formed with each leg 190 pointing outwards at an angle 192 not perpendicular to the ground. This angle 192 serves two functions. First, the angle of the training wheel leg insures that the training wheel 150, secured to the leg 190 with a training wheel nut 194, will strike the ground at an angle. As a result, at least one edge of the training wheel strikes the ground with such force that the edge creates a groove which aids in guiding the training wheels 150 and the tee bar 126. Referring briefly to FIG. 6, the training wheel 150 is shown having two different diameter edges, commonly referred to as "boss edges." In other words, the diameter 196 of one side of the training wheel 150 is different than the diameter 198 of the other side of the training wheel 150. This is so because two groove-forming edges are better than one and, as a result, provide better directional stability. It is to be appreciated that the skids discussed above could be attached to the training wheel assembly 148 and would provide similar directional stability.

A second function of the angle 192 between the training wheel legs 190 is to provide the angular crevice to assist in the shearing and pushing over of unwanted trees as discussed above in connection with FIG. 4. Although the angle between the training wheel legs is not critical, it is preferred that there be sufficient distance between the training wheels 150 to allow a tree of substantial size to pass between them and into the crevice.

Referring back to FIG. 5, the tree shear attachment 154 is shown extending out the back of the training wheel assembly 148. From this view, the manner in which the tree shearing blades 176 are mounted to the tree shear attachment 154 is clearly appreciable. Each tree shear blade 176 has a mounting socket 200 that is sized to slide over a mounting pin 202 formed on the end of the tree shear attachment 154. Each tree shear blade 176 is attached to an end of the tree shear ram 174 that pushes the ends of the tree shear blades 176 apart when actuated, thereby forcing the opposite ends of the tree shear blades 176 together. This allows the tree shear blades 176 to sever the trunk of a tree by positioning the blades on either side of the trunk and actuating the tree shear ram.

As shown in FIG. 5, the tee bar head 128 and tee arms 130 are equipped with four motors 132. It is to be appreciated, however, that any number of hydraulic motors 132 could be used in combination on the present invention. Each hydraulic motor 132 is mounted within either the tee arm 130 or the tee bar head 128, and secured in place with a pair of pivot pins 204. These pivot pins 204 engage into pivot holes 206 and allow the hydraulic motor 132 to rotate about the pivot pin. This rotation provides some directional control of the motor shaft 134 in order to sweep the cutting elements 138 horizontally from side-to-side. Such side-to-side movement will enhance the cutting ability of the cutting elements 138, as well as improve the dirt and debris throwing capabilities of the paddle teeth 144 and severe duty fire whips 146. Each hydraulic motor 132 is equipped with a motor ram 208 which is attached at one end to the rear of the motor housing 210, and at the other to a motor ram bracket 212 mounted to the wall of the tee arm 130 or tee bar head 128. By actuating the motor ram 208, the motor shaft 134 may be directed in a side-to-side manner.

Figure 7:
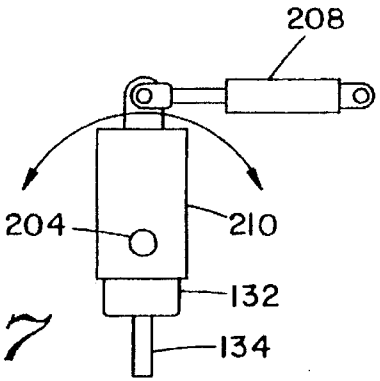
FIG. 7 is a detail view of the hydraulic motor, pivot pins, and motor ram taken along line 7—7 of FIG. 5.

FIG. 7 shows the detailed interaction of the hydraulic motor 132, motor pivot pin 204, and motor ram 208. From this view it is to be appreciated that once the pivot pin 204 is inserted into the pivot hole 206, the direction of the motor shaft 134 may be controlled by activation of the motor ram 208. It should be noted, however, that there is a practical limitation to the degree of rotation achievable by the motor ram 208. Specifically, because the motor shaft 134 extends out from the tee bar head 128 or tee arm 130 by its shaft length, the cutting elements 138 mounted to the cylindrical housing 166 at the end of the shaft 134 must not be positioned where they could strike the tee bars 126 themselves. As a result, the motor ram 208 can only realize an angular sweep of approximately twenty degrees from the perpendicular.

Figure 8:
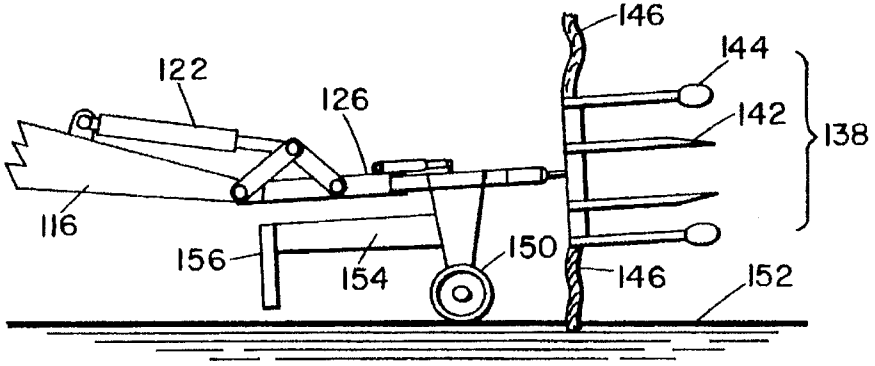
FIG. 8 is a detailed side view of the tee bar of the system of the present invention, showing the various components of the rotary cutting elements in a perpendicular orientation to the ground for brush and tree clearing.

Referring now to FIG. 8, the system of the present invention is shown in its ground sweeping and fire destruction mode. In this mode, the operator positions the tee bar 126 horizontally with the training wheels 150 on the ground. In this position, the tee bar head 128 and tee arms 130 are maintained at an optimal distance from the ground. Maintenance of this optimal distance insures that, once rotating, the severe duty fire whips 146 strike the ground 152 with sufficient force to clear away burning brush, yet do not significantly slowed of the rotation of the cutting elements. As discussed above, in order to assist the system operator in maintaining the training wheels 150 on the ground, a hydraulic float valve and ground radar system may be mounted to the training wheel assembly 148. Such a float valve will minimize the difficulty in maintaining the proper positioning of the cutting elements 138 while operating over rough terrain. Also while in the ground sweeping and fire destruction mode, the cutting elements 138 project horizontally in front of the tee bar head 128 and tee arms 130 to destroy any burning vegetation or debris.

Figure 9:
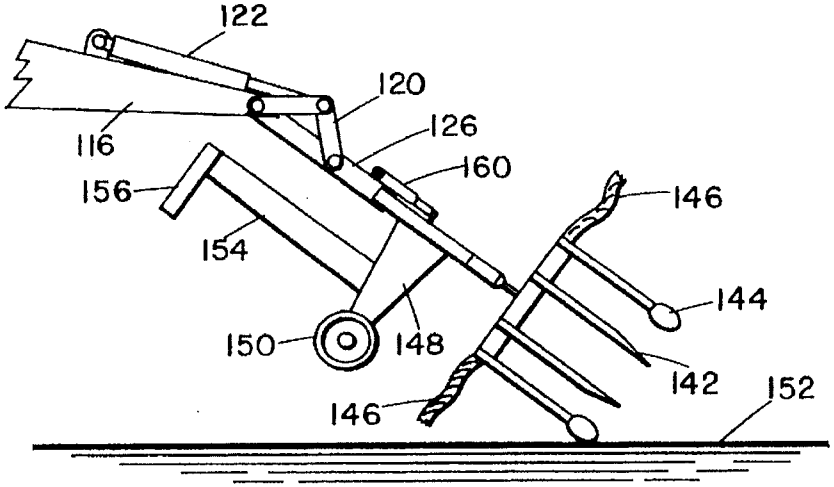
FIG. 9 is a detailed side view of the tee bar of the system of the present invention as in FIG. 6, with the tee arm at an acute angle to the ground for throwing dirt with the rotating paddle tooth blades.

Referring now to FIG. 9, the system of the present invention is shown in its dirt-throwing mode. In this mode, the operator of the excavator positions the tee bar 126 at an angle to the ground 152 such that the training wheels 150 are not resting on the ground 152. This position allows the paddle teeth 144 to strike the ground 152 and project dirt to one side of the system 100. This dirt projection is particularly useful for burying burning materials with earth in order to extinguish a fire.

Figure 10:
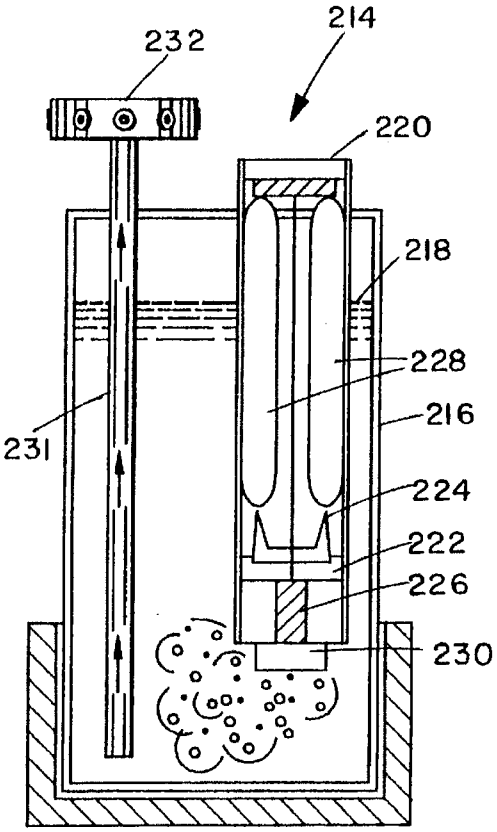
FIG. 10 is a cross-sectional view of the emergency fire retardant discharge unit.

Referring now to FIG. 10, the emergency fire retardant discharge unit 214 is shown in cross-section. The emergency fire retardant discharge unit 214 includes a cylindrical chamber 216 having an approximate volume of 45 gallons that is filled with fire retardant chemicals 218. A heat sensitive obturator 220 is mounted to the top of the chamber 216 to monitor the temperature of the surrounding area. In the event the outside temperature is higher than a preset safety temperature, the emergency fire retardant discharge unit 214 is activated. Such activation begins when a piston 222 with a pair of integral acicular, xyresic knives 224, is projected upwards by a compression spring 226 with sufficient force to puncture a pair of pressurized two-part chemical compound cylinders 228. Once punctured, the two-part chemical escapes the compound cylinders 228 and flows downwards through the cylinder port 230 to create an increase in the pressure within the chamber 216. This increased pressure forces the fire retardant chemicals 218 up through the discharge tube 231 for spraying by the high volume all directional nozzle sprinkler 232. By spraying the fire retardant chemicals 218 in all directions, the safety of the system is increased. More specifically, in the event of an emergency involving exposure of the system 100 to excessive heat, the activation of the emergency fire retardant discharge unit 214 will provide the operator with an opportunity to escape the fire and maneuver the vehicle to safety. In addition to nozzle sprinkler 232, an automatic or manual fire extinguisher (not shown) may be used to protect the interior of the cabin 108 from fire damage.

Figure 11:
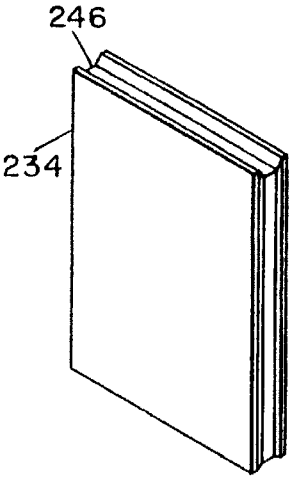
FIG. 11 is a perspective view of a typical fire shield panel.

Referring now to FIG. 11, a typical fire shield panel 234 is shown in perspective. This fire shield 234 consists of a multi-layer, heat-resistant material that insulates the system from the heat. Such materials may include a cementous fire-stop material, or a flexible fire-proof cloth. Applying the fire shield panels to the preferred embodiment requires that a large number of panels 234 be sized and shaped to cover virtually every exposed surface of the system 100 including the construction excavator. 102 Such surfaces would include, for example, the tee bar 126, tee arms 130, boom 104, crowd 116, engine compartment 110, periscope 236, tree shear attachment 154, and all other exposed surfaces of the system 100. It should be appreciated, however, that it would be difficult to fully shield the boom ram 114, crowd ram 118, and bucket ram 122 using a rigid fire shield panel 234. Consequently, fire shield blankets 235 (shown in FIG. 4) may be made of a soft, pliable material that would allow some degree of flexibility for covering moving parts. The fire shield panels 234 may be reinforced with a tensile fiber or wire mesh that would combine a high level of strength with a high temperature tolerance.

Suitable attachment means may be used to attach the fire shield to the exposed surfaces. Such means may include, for example, magnets or clamp fasteners. It should be noted, however, that any relatively secure, yet removable manner of attaching the fire shields could be used. Such removability would insure that the vehicle, once away from the fire fighting environment, could be returned to its original capacity simply by removing the fire shields 234.

Figure 12:
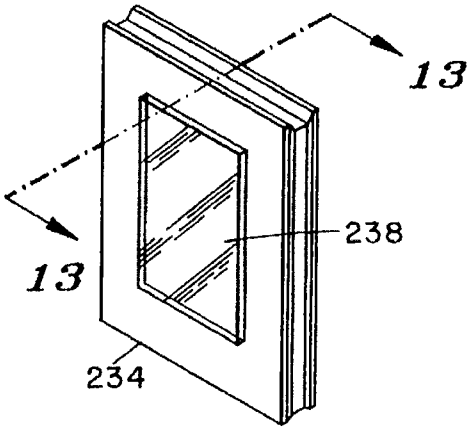
FIG. 12 is a perspective view of a typical fire shield panel having a heat resistant window.

Referring to FIG. 12, a typical fire shield 234 having a window 238 is shown. The window 238 is formed from a dual-glazed heat-resistant glass that is capable of withstanding extreme heat. In addition, the glass may be coated with a heat resistant coating for added heat tolerance. With such heat-resistance, the fire shield panels 234 with windows 238 can replace the existing windows of the construction excavator 102, thereby allowing the excavator to be exposed to heat far in excess of what an un-equipped excavator could withstand. It is also to be appreciated that, while the preferred embodiment of the present invention includes a construction excavator, any number of other vehicles could be used in the system of the present invention.

Figure 13:
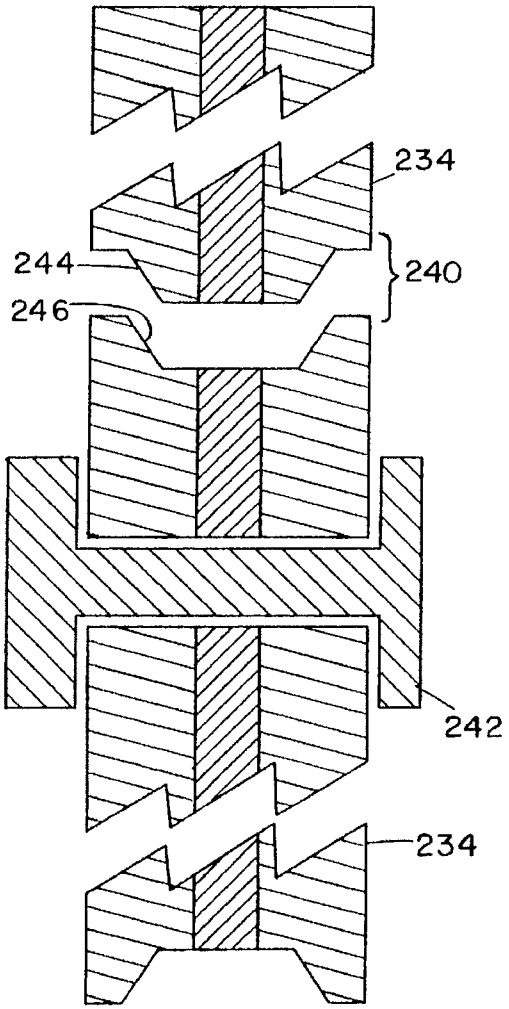
FIG. 13 is a cross sectional view of a typical fire shield panel taken along line 13—13 of Fig. showing the tongue-in-groove joints and the flexible "H" fire shield joint strip.

FIG. 13 is a cross-sectional view of a typical fire shield 234 showing a tongue-in-groove joint 240 between adjacent panels 234, as well as an H-shaped fire shield joint strip 242. In one embodiment, each fire shield panel 234 is formed with a tongue-shaped protrusion 244 on one side, and a groove-shaped crevice 246 on the other. Thus, when a tongue-shaped protrusion 244 of one panel is inserted into the groove-shaped crevice 246 of another panel, a resilient seal is created. This resilient seal creates a continuous heat barrier from one fire shield panel 234 to the next. In this manner, any number of fire shield panels 234 may be positioned adjacent each other to protect an area of significant size from heat damage.

In another embodiment of the fire shield, the H-shaped fire shield joint strip 242 functions much like the tongue-in-groove fire shield. Specifically, the H-shaped fire shield joint strip 242 seals two adjacent fire shield panels together, without the need for aligning tongue-in-groove edges. This is particularly useful when a typical fire shield must be cut in order to fit a peculiarly shaped component. In such circumstance, forming a tongue-shaped protrusion 244 or groove-shaped crevice 246 would be difficult. Referring briefly back to FIG. 4, the various techniques for mounting the fire shields are shown. Specifically, engine compartment 110 is shown partially covered with fire shield panels 234, with the panels being attached together with a tongue-in-groove 240. Also, cabin 108 is shown partially covered with fire shields 234 and joined together with H-strip 242. Boom 104 and cutting device 136 are shown partially covered with fire shield blanket 235. It is to be appreciated that although only portions of the system 100 are shown covered with the various shields, the entire system 100 can be covered.

Referring now to FIG. 14, the instrumentation periscope 236 is shown in further detail. Specifically, the periscope 236 is mounted to the top of a telescoping mast 248 that allows the periscope to be extended upwards from the roof of the excavator cabin 108. The instrumentation head 250 is preferably made from a material that withstands exposure to high temperature for an extended period of time. Importantly, the instrumentation head 250 is preferably formed with a window 252 on its front facing side that is covered with a heat shield having double-glazed, fire-resistant glass. This allows the instruments within the instrumentation head to peer outwards from the periscope 236 without being subjected to the extreme temperatures of the environment.

Mounted within the instrumentation head 250 of the periscope 236 are a number of cameras and antennae. More specifically, a video camera 254 is mounted within the instrumentation head 250 and directed through the window 252. The electronic output from the video camera 254 is routed via an electrical cable to a monitor (not shown) mounted within the excavator cabin 108. Additionally, an infrared video camera 256 is mounted within the instrumentation head 250, the output of which is also routed to the monitor within the excavator cabin 108. This configuration allows the operator of the system 100 to visualize the immediate surroundings of the system with the video camera 254, as well as the area of extreme heat with the infrared camera 256, thereby enabling the operator to direct the system 100 towards the most critical areas of the fire.

In addition to the two video cameras 254,256, the instrumentation head 250 also houses a radar transmitter/receiver and its associated boresight antennae 258. The output of the radar, like the video cameras, is routed to a video monitor in the excavator cabin 108. Also, Geographic Positioning System (GPS) and Global Information System (GIS) antennae are mounted within the instrumentation head 250. These antennae are connected to a GPS/GIS receiver which, in combination with a video monitor, provides a visual representation of the topography of the region where the system 100 is operating. Additionally, an antenna 264 for a two-way radio 262 is located on the instrument head 250 to provide bi-directional communication between the operator of the system 100 and other fire fighting personnel.

To assist the operator in managing all of the instrumentation, all electronic instrumentation signals are monitored by an onboard computer system (not shown). The computer system receives all video and GPS/GIS signals and generates composite video images on the cabin mounted computer monitor. From that image, the operator may instantly determine the local topography, fire line location, as well as the location of obstacles in the path of the system.

In order to maintain a comfortable environment for the operator of the system, a cabin climate control system equipped with an air filter is provided (not shown). Specifically, this climate control system protects the operator and instrumentation within the cabin from the extreme heat of the environment. To assist the operator in maintaining the safety of the fire fighting mission, a number of thermometers (not shown) are provided that give the operator an indication of the thermal environment. Such thermometers may be placed to sense the temperature in the engine compartment or inside the cabin 108. In fact, in order to insure that the temperature of both the engine compartment 110 and fuel storage tanks are maintained at a safe level, a dedicated fire alarm system may be attached to the temperature sensors to warn the operator of any hazardous temperatures.

OPERATION OF THE ABOVE DESCRIBED EMBODIMENT

The operation of the preferred embodiment of the present invention includes mounting the tee bar assembly on a suitable vehicle. As noted above, any suitable vehicle may be selected. The construction excavator 102, perhaps, is the best vehicle suited for heavy fire fighting duties because it has a track propulsion system and extended boom reach. Mounting of the tee bar assembly 124 includes attaching the tee bar to the bucket end of the crowd 116 and connecting it to the bucket hinge 120. This attachment method also includes connecting the hydraulic lines from the excavator 102 to the hydraulic lines of the hydraulic motors 132, tee bar ram 160, motor rams 208, tree shear ram 174, and tee arm rams 162. It is to be appreciated that a control mechanism is present in the tee bar head 128 and tee arms 130, activatable from the control console mounted within the cabin 102, which controls the operation of the various rams.

Following attachment of the tee bar assembly 124 and associated hydraulic lines, the instrumentation suite is installed on the vehicle being used. In this embodiment in which the system includes a construction excavator 102, the periscope 236 is mounted to the top of the excavator cabin 102, and the electrical control and signal cables are routed into the cabin. More specifically, the electrical signal wires that transmit the electrical signals from the video camera 254, infrared video camera 256, radar 258, GPS/GIS 260, and two way radio 262 are routed down the periscope 236 and inside the cabin. Inside the cabin, the control cables are attached to a periscope control device that enables the system operator to rotate the periscope for 360 degree viewing. Also inside the cabin 102, the signal cables from the video camera 254 and infrared video camera 256 are attached to a pair of video monitors that enable the operator to view both the true video image of the surroundings, as well as the infrared image of the surroundings showing areas of higher and lower heat. Additionally, the radar transmit and receive signals are connected to a radar system which displays a radar image of the fire fighting area on a monitor also within the excavator cabin. Further, the GPS/GIS antenna cable is attached to a GPS receiver that provides a video display identifying the topographical area of the fire fighting environment. Finally, the two-way radio equipment that is mounted within the cabin is attached to the two-way radio antenna 262 to provide bi-directional communication between the operator within the cabin and the other fire fighting forces.

In addition to the instrumentation suite, the emergency fire retardant discharge unit 214 is preferably mounted on a semi-flat surface on the vehicle. When the system is installed on an excavator, a preferred location for the discharge unit is on the engine compartment 110. This location is preferred because the discharge unit 214 can be securely mounted on the engine compartment 110, and because the engine compartment 110 is centrally located on the system. It should be appreciated, however, that if a different type of vehicle is used, the discharge unit may be mounted elsewhere. For example, were a bulldozer to be used, the discharge unit 214 could be installed on the roof of the operator's compartment or on the engine compartment. In any case, the discharge unit is preferably mounted on the vehicle in a central location where, when activated, the fire retardant chemicals 218 will spray sufficiently to protect all sides of the system 100.

Once the tee bar assembly 124, instrumentation suite, and emergency fire retardant discharge unit 214 are attached to the excavator 102, all exterior surfaces of the system are covered with the fire shield panels 234. Due to the extreme heat that will be present in the fire fighting environment, it is important that all exposed surfaces are protected with a fire shield panel 234. Because the hydraulic hoses and other flexible components of the construction excavator are exposed, a combination of both the rigid fire shield panels and flexible fire shield panels is required to adequately cover the system of the present invention. Once covered, the fire shield panels protect the excavator 102, tee bar assembly 124, instrumentation suite and, most importantly, the operator, from exposure to the extreme heat present in the fire fighting environment. This protection allows the fighting of a fire at point-blank range, thereby increasing the usefulness of the system while simultaneously decreasing the danger to its operators.

The operation of the system of the present invention includes positioning the vehicle at the front line of a fire. Once positioned, the operator establishes communications with other fire fighting personnel to coordinate the movement of the system of the present invention. Then, by viewing the monitors within the cabin, the operator may visualize the surrounding area with the video camera, the areas having the most intense heat with the infrared video camera, the overall topography of the area with the GPS/GIS monitor, and the presence of any unknown obstacles with the radar monitor. Thus, by simply viewing the monitors within the cabin, the operator may fully understand the entire fire fighting environment, and attack the fire accordingly.

Once the operator has determined a plan for attacking the fire, the operator positions the system 100 with the tee bar 126 positioned adjacent the fire line using the boom 104, boom ram 114, crowd 116, crowd ram 118, and bucket ram 122, such that the training wheels 150 are on the ground 152. Then, the tee bar ram 160 is adjusted so that the tee bar head 128 and tee arms 130 are perpendicular to the fire, and the motor rams 208 are adjusted so that each motor shaft 134 is perpendicular to the tee arms 130.

Prior to attacking the fire, the operator activates the hydraulic motors 132 thereby spinning the cutting elements 138 in either a clockwise, or counterclockwise direction. Such direction selection is determined by whether the system 100 is attacking from a position where the fire is on the left of the vehicle, or from a position where the fire is on the right of the vehicle. For example, if the fire is on the left of the vehicle, the rotation as viewed from the operator would be clockwise. This clockwise rotation would cause the burning debris on the ground to be thrown to the left as it struck by the severe duty fire whips 146. Likewise, as any burning vegetation which is struck with the cutting elements 138 is also thrown to the left. Thus, as the system 100 advances along the fire line, the burning debris is thrown back into the fire, leaving a fire-free path with no combustible material.

Once the fire has been successfully extinguished, the system 100 may be loaded onto a trailer for movement to another fire location. In order to fit on the trailer, the tee arms 130 must be bent upwards from the tee bar head 128. This movement is accomplished by removing the tee arm pin 188 and activating the tee arm rams 162 to lift the ends of the tee arms upward. Once the tee arms 130 are raised, the width of the system is small enough to fit on the standard excavator trailer for easy transport. Additionally, in the event the excavator 102 should be returned to regular service, the instrumentation suite and fire shielding 234 may be easily removed and stored for future use.

What I claim:

1. A fire fighting system comprising:

a base comprising a construction equipment-type vehicle with a substantially enclosed operator compartment and at least one hydraulic take-off, a hydraulically controlled arm extensible outwardly from said vehicle to at least a distance from said vehicle equal to its own length, a support bar mounted at the distal end of said arm, a plurality of motorized rotary cutting devices mounted along the length of said bar, control means to orient said bar and cutters relative to the ground and the advancement path of said vehicle in motion, and means to control and drive operation of said motorized cutters, and means for heat deflection and fire retardation mounted on said vehicle, operator compartment, arm and cutting devices whereby said vehicle may safely advance into a burning fire front and clear a path through the burning material by operation of said cutters.

2. The system of claim 1 wherein the motive means of said vehicle is a dual tread drive.

3. The system of claim 1 wherein the vehicle is an excavator.

4. The system of claim 1 wherein the motorized rotary cutting devices comprise a rotating hub supporting a plurality of cable whip cutter elements.

5. The system of claim 1 wherein the motorized rotary cutting devices comprise a rotating hub supporting a plurality of rigid cutter blades.

6. The system of claim 1 wherein the means to control and drive said cutters is a plurality of hydraulic motors.

7. The system of claim 1 wherein the means to control and drive said cutters is an electric motor.

8. The system of claim 1 wherein the means to control and drive said cutters is a mechanical take-off from said vehicle to gear drive linkages of said cutters.

9. The system of claim 1 wherein said heat deflection means is noncombustible blanket-type fire shielding arrayed over said vehicle, compartment and arm.

10. The system of claim 1 wherein said heat deflection means is plate-type shielding arrayed over said vehicle, compartment and arm.

11. The system of claim 10 wherein said heat deflection means further comprises a system of fire barrier shields of cementitious material cast into frames and attached to said vehicle.

12. The system of claim 1 wherein said means for fire retardation is a liquid containment and delivery system for spraying said vehicle, compartment, arm and cutters selectively as said vehicle is contacted by fire.

13. The system of claim 1 further comprising fire protection devices applied the exterior of said operator compartment.

14. The system of claim 13 wherein said fire protection devices are heat resistant silica glass.

15. The system of claim 1 further comprising a periscope as a vehicle navigation mechanism and fire fighting aid.

16. The system of claim 1 further comprising an operator viewing system comprising a video camera system as a vehicle navigation mechanism and fire fighting aid.

17. The system of claim 1 further comprising exterior radar sensors to aid the operator in directing and controlling the vehicle as it advances into the fire.

18. A fire fighting system comprising:

a base comprising a construction equipment-type vehicle with a substantially enclosed operator compartment and at least one hydraulic take-off;

a hydraulically controlled arm extensible outwardly from said vehicle to at least a distance from said vehicle equal to its own length, said arm having a bucket hinge pivotally mounted at the distal end of said arm;

a support bar attached to said bucket hinge with a pin, said support bar moveable with said bucket hinge;

a plurality of motorized rotary cutting devices mounted along the length of said bar;

control means to orient said bar and cutters relative to the ground and the advancement path of said vehicle in motion;

means to control and drive operation of said motorized cutters; and means for head deflection and fire retardation mounted on said vehicle, operator compartment, arm and cutting device.

* * * * *